US009410390B2

(12) United States Patent
Tolstihin et al.

(10) Patent No.: US 9,410,390 B2
(45) Date of Patent: Aug. 9, 2016

(54) DEVICE FOR DRILLING THROUGH A FORMATION

(76) Inventors: Stanislav Tolstihin, Tyamen (RU); Segey Kharitonov, Moscow (RU)

( * ) Notice: Subject to any disclaimer, the term of this patent is extended or adjusted under 35 U.S.C. 154(b) by 614 days.

(21) Appl. No.: 13/818,675

(22) PCT Filed: Aug. 24, 2011

(86) PCT No.: PCT/IB2011/001943

§ 371 (c)(1),
(2), (4) Date: Apr. 11, 2013

(87) PCT Pub. No.: WO2012/025816

PCT Pub. Date: Mar. 1, 2012

(65) Prior Publication Data

US 2013/0192815 A1 Aug. 1, 2013

(30) Foreign Application Priority Data

Aug. 24, 2010 (RU) ..... 2010135052

(51) Int. Cl.
*E21B 29/00* (2006.01)
*E21B 43/112* (2006.01)

(52) U.S. Cl.
CPC ..... *E21B 29/005* (2013.01); *E21B 43/112* (2013.01)

(58) Field of Classification Search
CPC ..... E21B 29/005; E21B 43/112; E21B 29/06; E21B 25/16; E21B 29/007
USPC ..... 166/55.8; 175/61, 62, 73, 74, 77, 78, 175/80, 81, 75, 76
See application file for complete search history.

(56) References Cited

U.S. PATENT DOCUMENTS

| | | | | | |
|---|---|---|---|---|---|
| 2,216,963 | A * | 10/1940 | Sinclair | ..... | 166/55.3 |
| 2,456,331 | A * | 12/1948 | Sewell | ..... | 175/77 |
| 4,809,775 | A * | 3/1989 | Fortin | ..... | 166/55.7 |
| 5,009,273 | A * | 4/1991 | Grabinski | ..... | 175/61 |
| 7,537,055 | B2 * | 5/2009 | Head et al. | ..... | 166/298 |
| 2005/0067166 | A1 * | 3/2005 | Trueman et al. | ..... | 166/313 |
| 2009/0308605 | A1 * | 12/2009 | McAfee et al. | ..... | 166/255.1 |

* cited by examiner

*Primary Examiner* — Michael Wills, III
(74) *Attorney, Agent, or Firm* — John Alumit

(57) ABSTRACT

In order to reduce the risk of accidents in mechanically drilling through a stratum and to expand the range of applications of the device for drilling through a stratum, the invention provides that the control elements—which ensure the in-feeding of the cutting rod and the return of the device to the position for being transported by means of interacting the ball-and-socket joint with the control bushing and the body—are embodied as two-stage figure projections on the lateral truncations of the ball-and-socket joint, which cooperate with cutouts in the control bushing and the body; and the line of pipes and the hydraulic motor of the suspension and of the pivot point are optionally replaced by a cable and by an electric motor combined with a hydraulic pump.

8 Claims, 2 Drawing Sheets

DEVICE FOR DRILLING THROUGH A FORMATION

CROSS-REFERENCE TO RELATED APPLICATION

This application claims the benefit of the priority filing date in PCT/IB2011/001943 and referenced in WIPO Publication No. WO/2012/025816. The earliest priority date claimed is Aug. 24, 2010.

FEDERALLY SPONSORED RESEARCH

None

SEQUENCE LISTING OR PROGRAM

None

BACKGROUND

The invention relates to a device for drilling through a stratum as generically defined by the preamble to claim 1.

The device is usable in the gas and oil industry for forming a hydrodynamic connection (channels) between a fluid-saturated stratum and a borehole (perforation).

A device for drilling through a formation is known (Patent No. 2070358 E 21 B 43/11), which has a body with a longitudinally oriented cutout in a wall. Also provided are: a suspension in the form of pipes for a body; a cutting rod, which is accommodated opposite the longitudinally oriented cutout of the body, a control bushing and bushing, and is set up rotatably in a ball-and-socket joint; a pivot point in the form of a hydraulic motor; a rotation transmission point in the form of a link mechanism; an in-feed point of a cutting rod, which represents a ball-and-socket joint that is braced on the bushing and which cooperates with a cushioned control bushing; and a hydraulic anchor cut.

One problem of this known device is the lack of cutting value feedback (of the torque and the contact pressure of the cutting rod), which leads to overloads on the lower joint of the rotation transmission point. The cutting edges of the cutting rod are colored, and a serial-rail hydraulic motor is used, which is predetermined for work with axial pressure compensation upon loading onto a chisel. When cutting, the device points toward the opposite wall and thus reduces drilling depth.

The device which drills through a formation (Patent No. 92145563 E 21 B 43/11) and is selected as a prototype for the invention has a body with a longitudinally oriented cutout in the wall; a body suspension in the form of pipes; a cutting rod placed opposite the longitudinally oriented cutout in the body on a control bushing and bushing, and disposed rotatably in a ball-and-socket joint; a pivot point embodied in the form of a hydraulic motor for a mine level; a cutting rod in-feed point, which has a ball-and-socket joint in the form of a ball truncated on a side, that is braced on the bushing and represents a cushioned control bushing cooperating with the bushing; an anchor cut, which is embodied in the form of a hydraulically imbalanced bush with wedges mounted in articulated fashion thereon; a rotation transmission point in the form of a link mechanism, which is distinguished in that the device is additionally equipped with a feedback point in the form of a constricting element that is disposed in the annular gap between the control bushing and the pivot point shaft; a pressure point of the device toward the borehole wall, in the form of one or more rotary bodies, which is or are disposed in the body and in the control bushing opposite the longitudinally extending cutout in the body; and an axial bearing and infeed point of the cutting rod introduced into the spindle construction of the pivot point, with the possibility of absorbing operating pressure from the feedback point.

Above-ground testing patterned after the model device for drilling, as embodied in Patent N92145663, revealed that at the conclusion of the cutting cycle, the device failed to return to the position required for transport (the axis of the cutting rod coincides with the axis of the device). In-feeding of the cutting element is done at the expense of rotating the ball-and-socket joint (braced on the bushing) about the horizontal axis of rotation when the control elements interact. The control elements are placed eccentrically relative to the horizontal axis of rotation and are formed by cylindrical pins secured to the ball-and-socket joint, which are guided in horizontal cutouts in the control bushing as they are displaced downward. To strengthen the control element/detail pairing, a sliding placement of the ball-and-socket joint in the control bushing is employed with some tension. Therefore, upon the control bushing's return motion, the ball-and-socket joint is simply lifted away via the bushing and remains in the operating position. The kinematic connection of the ball-and-socket joint to the body (resulting from the cutting operation when the joint interacts with the bushing secured in the body), is wasted during the control bushing's return motion. The mechanics of the line of pipes, which are subjected to the pulsation of internal pressure in the borehole's complicated profile [which is true of the great majority of modern boreholes] is such that at the fastening point (the mine bottom anchor), axial and rotational stresses accumulate, which, upon weighing the anchor (of the hydraulic, in this case when circulation is interrupted), can lead to denting and damage to the control element, which is not in the operating position.

The objective of the invention is to reduce the risk of accidents in mechanically drilling through a stratum, and to expand the range of applications of the device for drilling through a stratum.

This object is attained by means of the features recited in claim 1.

SUMMARY

The goal of returning a device for drilling through a stratum to the operating position at the conclusion of a cutting cycle is attained by means of a change in the construction of the control element by simultaneously interacting the ball-and-socket joint with the running support, the control bushing and the body of the device. The ability to replace the pipe suspension is possible by means of a geophysical electrical cable. The hydraulic motor of the pivot point can then be replaced with an electric motor combined with a hydraulic pump. For boreholes that have an uncomplicated profile, the ability to suspend a geophysical electrical cable is considerably sped up by replacing the hydraulic motor with an electric motor combined with a hydraulic pump. Operation becomes less expensive. The precise adaptation of perforation intervals is ensured by geophysical methods.

DRAWINGS

REFERENCE NUMBERS

Figure 1:
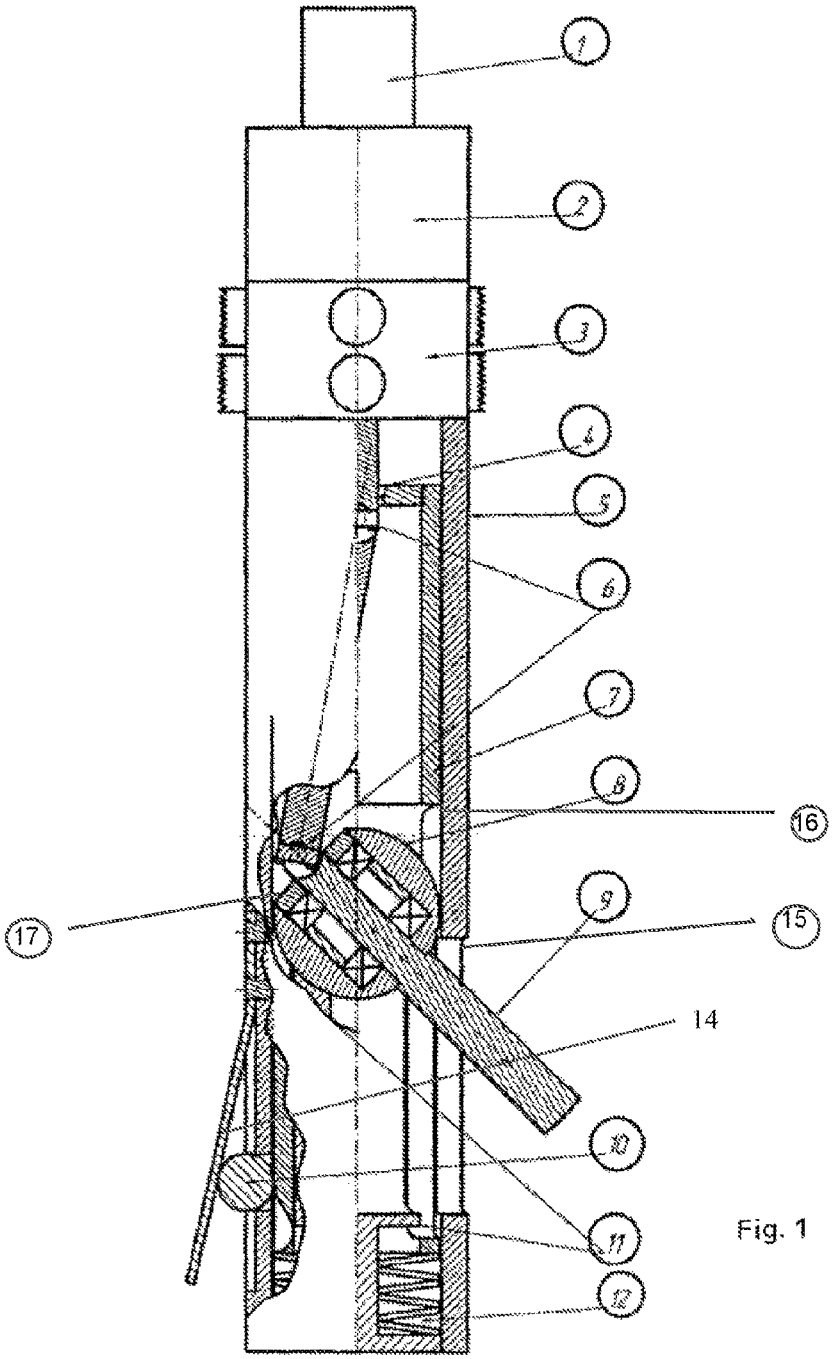
FIG. 1 shows the device in the operating position at the conclusion of the cutting cycle.
Figures 2, 3, 4:
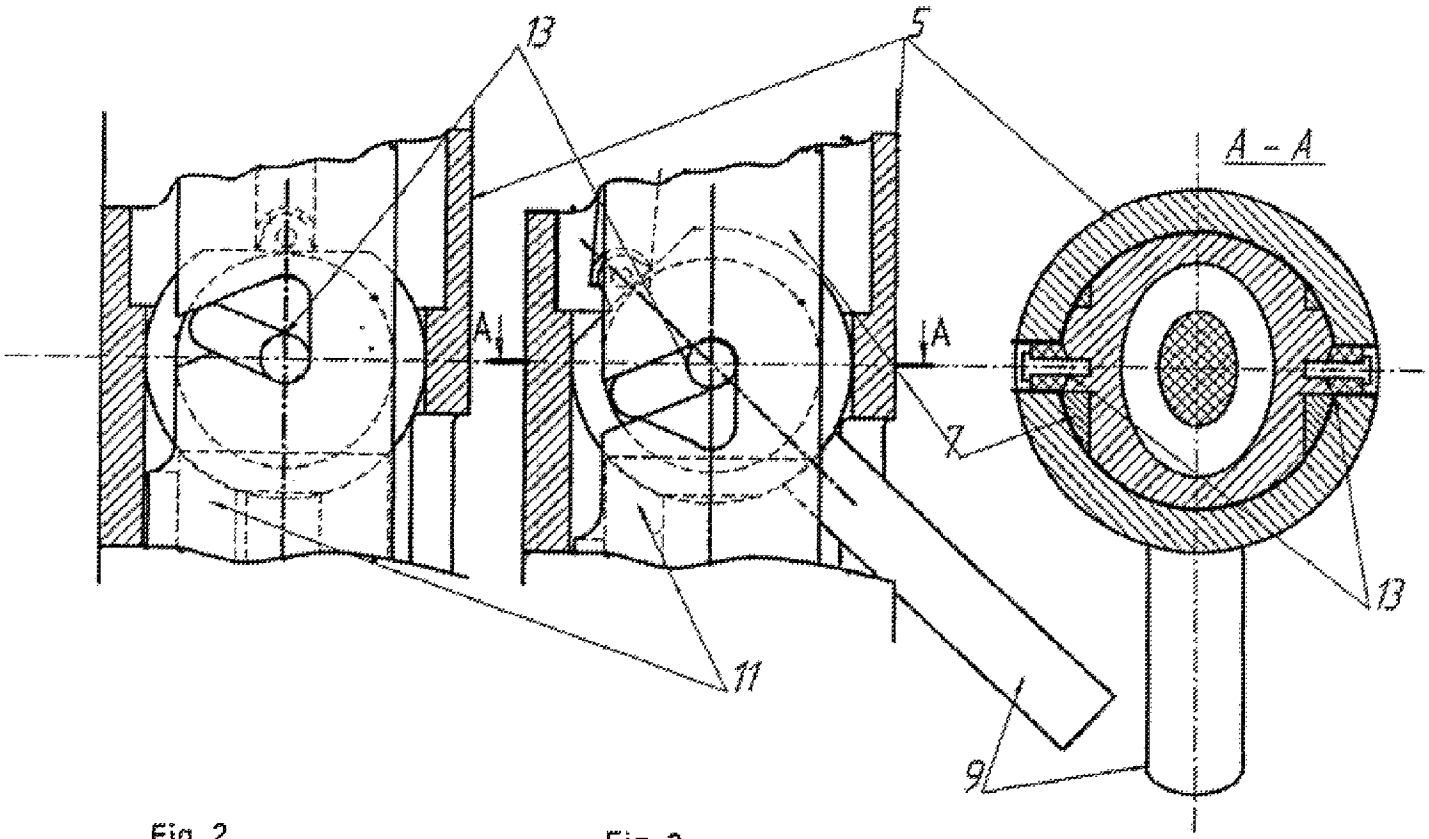
FIGS. 2 and 3 show the types of in-feed points of the cutting rod with the cut, with the body of the device in the position for being transported and after the conclusion of the cutting cycle. The drawings show the interaction of the ball-and-socket joint with the control bushing and bushing.
FIG. 4 shows a section along the line A-A of FIG. 3, which illustrates the interaction of the ball-and-socket joint with the body of the device that is necessary for returning the device to the position for being transported.

1—the suspension of the device
2—the pivot point
3—the anchor cut
4—the constricting device of the feedback point
5—the body of the device
6—the link mechanism of the rotation transmission point
7—the control bushing
8—the ball-and-socket joint of the infeed point of the cutting rod
9—the cutting rod
10—the pressure point of the device toward the borehole wall
11—the bushing of the ball-and-socket joint
12—the control bushing spring
13—the control elements of the infeed point of the cutting rod.
14—the spring plate
15—cutout (of the body)
16—cutout (of the control bushing)
17—ball truncated on a side The device draws down onto the cutting point on the suspension 1, which is embodied in the form of pipes or an electrical cable and has a pivot point 2 in the form of a hydraulic motor, or of an electric motor combined with a pump. The fixation point on the cutting point 3 is embodied in the form of a hydraulic anchor cut 3 and is located inside the body 5. The feedback point 4 is embodied in the form of a constricting device, which is secured to the control bushing 7. The rotation transmission point 6 is embodied in the form of a link mechanism. The in-feed point of the cutting rod is embodied in the form of a ball-and-socket joint 8, braced on the bushing 11 that is solidly connected to the body 5, which cooperates with the control elements 13 (the two-stage figure projections on the lateral truncations of the ball-and-socket joint 8) and cooperate with the control bushing cutouts (16), which are braced on the control bushing springs 12. For the in-feed point of the cutting rod 9 to work, there are openings in the body 5 and special cutouts in the control bushing 7. The control elements 13, which ensure in-feeding of the cutting rod 9, are embodied as two-stage figure projections on the lateral truncations of the ball-and-socket joint 8. The first stage of the control element 13 is eccentric, which is located in the figure cutout of the control bushing 7 and cooperates with the cut-out in the control bushing 7 upon being repositioned. The second stage of the control element 13 is cylindrical. It is located on the horizontal turning axis of the ball-and-socket joint 8, and cooperates with cylindrical openings in the body 5. In the cutting operation, and upon rotation of the ball-and-socket joint 8 braced on the bushing 11, the in-feeding of the cutting rod 9 takes place at the expense of the control elements' 13 first stage interacting with the figure cutouts of the control bushing 7. The interaction of the second stage of the control elements 13 with the body 5 is redundant. The primary task of the second stage of the control elements 13 is to maintain the position of the ball-and-socket joint's 8 axis of rotation relative to the body 5, which also ensures the device's adjustment into the position for being transported upon the control bushing's 7 return motion and upon interaction of the control bushing's 7 cutouts with the control elements' 13 first stage. The body 5, the bushing 11 and the control bushing 7 have longitudinally oriented cutouts for emergence of the cutting rod 9, which are opposite the pressure point of the device toward the wall and thus act as a cushioned rotary body 10, which is disposed in special cutouts in the body 5 and in the control bushing 7.

The device functions as follows: The hydraulic motor on the pipes, or the electric motor combined with the hydraulic pump (pivot point 2), create torque and the consumption of fluid; the greater the torque, the lower the revolutions of the motor and the lower the fluid consumption (in this plan, the characteristics of a hydraulic motor of the three-dimensional type and an electric motor seated on the shaft of a hydraulic pump agree). The torque of the pivot point 2 is transmitted to the cutting rod 9 by means of a link mechanism 6. The fluid consumption is converted at the constricting device 4 into an operative pressure that fixes the device at the cutting point (the anchor cut 3) and compresses the control bushing spring 12. The fluid consumption is converted by interaction of the constructive elements into a contact pressure from the cutting rod 9 against the borehole wall. The interaction of the cutting rod 9 with the operating line of pipes and the rock increases the torque at the pivot point. The motor revolutions and the output of fluid decrease, which leads to a reduction in the operative pressure on a feedback point and a reduction in the contact pressure of the cutting rod 9 against the borehole wall. In the course of this, the torque decreases. The fluid consumption, the operative pressure on the feedback point, and the contact pressure of the cutting rod 9 against the wall increase, which leads to an increase in the torque. Thus, an optimal cutting regimen can be achieved for the concrete pivot point 2 and the cutting rod 9 by means of selecting parameters for the constricting element 4 and the control bushing spring 12. At the conclusion of the cutting cycle, when the cutting rod's 9 angle of inclination is at a maximum and the control bushing 7 strikes something, the torque drops; the motor revolutions increase; and on the surface, a drop in denting pressure, or a drop in the electric motor load, can be seen. The return of the device to the position for being transported and the weighing of the anchor occur upon the interruption of circulation (the cessation of supply to the electric motor). The anchor's switching pressure and the control bushing's 7 spring hardness are selected such that the weighing of the anchor takes place after the return of the cutting rod 9 to the position for being transported. By introducing a new kinematic connection between the ball-and-socket joint 8 to the control bushing 7 and the body 5 of the device, the cutting rod's 9 return to the position for being transported is effected automatically and with significant effort, which is ensured by the control bushing spring's 12 tension. Moreover, the emergence of the cutting rod 9 from the apparatus is comparable to at least to the diameter of the device and not to the radius of the device (disk milling cutter).

What is claimed is:

1. A device for drilling through a stratum, comprising a body (5); a suspension (1) in the form of a line of pipes, a cutting rod (9) that is accommodated in a longitudinally oriented cutout (15) of the body (5) between a control bushing (7) and a bushing (11) and supported rotatably in a ball-and-socket joint (8); a pivot point (2) in the form of a hydraulic motor; an in-feed point of the cutting rod (9), which has the ball-and-socket joint (8) in the form of a ball truncated on a side (17), that is braced on the bushing (11) and cooperates via control elements (13) with the control bushing (7); an anchor cut (3) in the form of a hydraulic anchor; a rotation transmission point in the form of a link mechanism (6); a feedback point in the form of a constricting element (4) that is located in an annular gap between the control bushing (7) and the pivot point shaft; a pressure point (10) toward the borehole wall in the form of a spring plate (14); a rotary body, which is located in the body (5) and cutout (16) of the control bushing (7) opposite the longitudinally oriented cutout (15) of the body (5), wherein, the control elements (13), which ensure an in-feeding of the cutting rod (9) and the return of the device to the position for being transported by means of interaction of the ball-and-socket joint (8) with the control bushing (7) and the body (5), are embodied as two-stage figure projections on lateral truncations of the ball-and-socket joint (8), which cooperate with the cutout in the control bushing (7) and the body (5).

2. The device according to claim 1, wherein, the return of the device to the operating position at the conclusion of the cutting cycle is achieved by a variation in the construction of the control element (13) by simultaneously interacting the ball-and socket joint (8) with the bracing of the control bushing (7) and the body (5).

3. The device according to claim 1, wherein, the anchor cut (3) is placed in the body (5); and the feedback point is secured as a constricting device (4) on the control bushing (7).

4. The device according to claim 1, wherein a first stage of the control element (13) is eccentric, which is located in the cutout of the control bushing (7) and cooperates with the cutout of the control bushing (7) upon the repositioning thereof; and a second stage of the control element (13) is cylindrical, is located on the horizontal axis of the ball-and-socket joint (8), and cooperates with cylindrical openings in the body (5).

5. The device according to claim 4, wherein, in the cutting operation, the in-feeding of the cutting rod (9) upon the rotation of the ball and socket joint (8) braced on the bushing (11) is effected because of the interaction of the first stage of the control elements (13) with the cutouts of the control bushing (7); and the interaction of the second stage of the control elements (13) with the body is redundant.

6. The device according to claim 5, wherein the second stage of the control elements (13) ensures the maintenance of the position of the pivot axis of the ball-and-socket joint (8) relative to the body (5); and upon the return motion of the control bushing (7) and the interaction of the cutouts of the control bushing (7) with the first stage of the control elements (13), ensures the adjustment of the device into the position for being transported.

7. The device according to claim 1, wherein the body (5), the bushing (11) and the control bushing (7) have longitudinally oriented cutouts that allow the cutting rod (9) to emerge from the body (5) and bushing (11), said cutouts are located opposite the pressure point of the device toward the wall and thus form a cushion for the rotary body (10), which is located in special cutouts of the body (5) and of the control bushing (7).

8. A device for drilling through a stratum, comprising a body (5); a suspension (1) in the form of a cable, a cutting rod (9) that is accommodated in a longitudinally oriented cutout of the body (5) between a control bushing (7) and a bushing (11) and supported rotatably in a ball-and-socket joint (8); a pivot point (2) in the form of an electric motor combined with a hydraulic pump; an in-feed point of the cutting rod (9), which has the ball-and-socket joint (8) in the form of a ball, truncated on a side, that is braced on the bushing (11) and cooperates via control elements (13) with the control bushing (7); an anchor cut (3) in the form of a hydraulic anchor; a rotation transmission point in the form of a link mechanism (6); a feedback point in the form of a constricting element (4) that is located in an annular gap between the control bushing (7) and a pivot point shaft; a pressure point (10) toward the borehole wall in the form of a spring plate (14); a rotary body, which is located in the body (5) and cutout of the control bushing (7) opposite the longitudinally oriented cutout of the body (5), wherein, the control elements (13), which ensure an in-feeding of the cutting rod (9) and the return of the device to the position for being transported by means of interaction of the ball-and-socket joint (8) with the control bushing (7) and the body (5), are embodied as two-stage figure projections on lateral truncations of the ball-and-socket joint (8), which cooperate with the cutouts in the control bushing (7) and the body (5).

* * * * *